US005915689A

United States Patent [19]

Everdyke et al.

[11] Patent Number: 5,915,689

[45] Date of Patent: Jun. 29, 1999

[54] QUICK CHANGE SWIPER BLADES

[75] Inventors: Wayne D. Everdyke; Richard J. Milillo, both of Fairport, N.Y.

[73] Assignee: Xerox Corporation, Stamford, Conn.

[21] Appl. No.: 08/914,274

[22] Filed: Aug. 19, 1997

[51] Int. Cl.[6] ..... B65H 9/00

[52] U.S. Cl. ..... 271/236; 271/113; 271/184; 271/250

[58] Field of Search ..... 271/113, 236, 271/250, 184

[56] References Cited

U.S. PATENT DOCUMENTS

| | | | |
|---|---|---|---|
| 4,541,626 | 9/1985 | Millen | 271/236 |
| 4,826,383 | 5/1989 | Millen | 414/789.9 |
| 4,989,854 | 2/1991 | McNamara | 271/3.1 |
| 5,048,812 | 9/1991 | Holmes | 271/11 |
| 5,050,859 | 9/1991 | Paxon | 271/270 |
| 5,166,735 | 11/1992 | Malachowski | 355/282 |
| 5,260,757 | 11/1993 | Frank et al. | 355/317 |
| 5,468,834 | 11/1995 | Finsterwalder et al. | 271/236 X |
| 5,623,722 | 4/1997 | Hawley et al. | 399/397 |

*Primary Examiner*—Boris Milef
*Attorney, Agent, or Firm*—John S. Wagley

[57] ABSTRACT

A blade for use in an apparatus for urging sheets against registration edges in a sheet compiler is provided. The blade includes a body having a contact surface for contact with the sheets and a locating feature. The locating feature is connected to the body for locating the blade to the apparatus. The locating feature includes a prevention feature for preventing the blade from being inserted into the apparatus in a first orientation and to permit the blade to be inserted into the apparatus in a second orientation, opposed to the first orientation, so that the blade is properly installed into the apparatus.

28 Claims, 7 Drawing Sheets

QUICK CHANGE SWIPER BLADES

The present invention relates to feeding substrates through an electrophotographic printing machine. More particularly, the invention relates to compiling sheets into a set of printed sheets.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

High speed copying machines are becoming increasingly popular. These machines have a capacity or output capacity of say, for example, over 60 copies per minute. These machines are able to use single cut sheets of paper of various size such as A4, 8½×11, or 8½×14 inch copy sheets. These machines may be of the light lens, xerographic machine or may be a printer with digital input. Single, cut sheet printing machines are now available at speeds around 200 cpm.

The primary output product for a typical electrostatographic printing system is a printed copy substrate such as a sheet of paper bearing printed information in a specified format. Quite often, customer requirements necessitate that this output product be configured in various specialized arrangements or in print sets ranging from stacks of collated loose printed sheets to tabulated and bound booklets.

Modern high speed printing machines often include a separate area section or portion of the machine in which the sheets are gathered, ordered or compiled and bound together either by stapling, gluing or binding to form sets of sheets.

Prior to binding, gluing or stapling, the sheets and inserts within a set of sheets for binding or stapling need to be registered, aligned or placed accurately with respect to each other such that a set may have a quality appearance. Therefore, printing machines and in particular the finishing section typically include a compiler tray in which the sheets are urged against registration points on at least two adjacent edges of the sheets to provide for accurate registration and alignment of adjoining sheets.

One method of providing accurate compiling of sheets is to urge the top sheet of a set of sheets against the registration points within the compiler tray. One method of accomplishing this is by the use of a flexible component, for example, a flexible blade or finger which is flexed or distorted as it urges the sheet toward the registration positions. These blades or fingers are in constant contact with the copy sheets and as such have a high incidence of wear. These registration fingers or blades must be replaced on a regular basis.

The registration fingers must be accurately positioned and securely fastened within a compiler tray mechanism. Because of the high speed capacity of modern printing machines, the fingers or blades within the registration device of the compiler tray may require a difficult removal of the fingers or blades from the registration compiler tray assembly. Further, it is important that the registration blades or fingers be accurately and properly positioned within the compiler tray assembly.

This is particularly difficult for the machines described above running at speeds of as high as 200 cpm.

The quick change swiper blades of the present invention are intended to alleviate at least some of the problems heretofore mentioned.

The following disclosures relate to the area of inserting one or more insert sheets among a plurality of previously marked sheets:

U.S. Pat. No. 4,541,626 Patentee: Millen Issued: Sep. 17, 1985

U.S. Pat. No. 4,826,383 Patentee: Millen Issued: May 2, 1989

U.S. Pat. No. 4,989,854 Patentee: McNamara Issued: Feb. 5, 1991

U.S. Pat. No. 5,048,812 Patentee: Holmes Issued: Sep. 17, 1991

U.S. Pat. No. 5,050,859 Patentee: Paxon Issued: Sep. 24, 1991

U.S. Pat. No. 5,166,735 Patentee: Malachowski Issued: Nov. 24, 1992

U.S. Pat. No. 5,260,757 Patentee: Frank, et al. Issued: Nov. 9, 1993

U.S. Pat. No. 5,623,722 Patentee: Hawley et al. Issued: Apr. 22, 1997

The relevant portions of the foregoing disclosures may be briefly summarized as follows:

U.S. Pat. No. 4,541,626 discloses a sheet registration system for registering a sheet on a surface against a registration stop. The system includes a wiper device including a plurality of blades rotatable about an axis which is generally normal to the surface.

U.S. Pat. No. 4,826,383 discloses a sheet stacker in which sheets are compiled in a tray against a registration and a compiled set is ejected. The registration members are retracted by an eject mechanism comprising a continuously rotating drive roller projecting through the base of the tray.

U.S. Pat. No. 4,989,854 discloses a set of copy sheets deposited on a surface. The set is delivered positively to an output by engaging the trailing edge of the set with at least two hook-ended protections intended to overlie the top sheet. The hooks prevent the beam strength of the set lifting the trail edge of the set out of contact with the projections.

U.S. Pat. No. 5,048,812 discloses a sheet feeding apparatus capable of feeding corrugated cardboard sheets without the need for feed rolls. The apparatus includes a support for the sheet having a feed end and a delivery end. The support also includes feed elements comprising at least one feed element driven a variable speed and one feed element driven at a constant speed.

U.S. Pat. No. 5,050,859 discloses a conveyor system for transporting sheets between two process stations in a hard copy output apparatus. This system includes a plurality of interleaved belts which extend between the process stations and around rollers of different diameters to selectively raise the belts in a predetermined fashion for contact with the sheet at specific portions along the sheet transfer path.

U.S. Pat. No. 5,166,735 discloses a sheet transport system which incorporates a control for matching drive speeds imparted to a sheet extending between adjacent workstations. The copy sheet is engaged by a receiving surface disposed between the workstations and is adhered to the receiving surface by a vacuum.

U.S. Pat. No. 5,260,757 discloses a laser printer having a photoreceptor belt and a transfer station for transferring toner images to copy sheets. The sheets are registered upstream of a transfer station in the nip on a set of registration rolls. When the sheet has been registered the rolls are rotated and accelerated at a speed 20% greater than normal operating speed.

U.S. Pat. No. 5,623,722 discloses a document set compiler and eject apparatus including a belt transport system as well as an output roll system. The belt and rolls of each respective system operate in conjunction to one another to provide a smooth and efficient transfer to an output tray. The output rolls are located down stream of the belt and are driven at a speed substantially grater than the speed of the transfer belt.

As will be seen from an examination of the cited prior art, it is desirable to provide an electrostatographic copying machine with a sheet compiler with easier and more reliable replacement of compiler blade in a sheet output tray for a printing machine This invention is directed to providing easier and more reliable replacement of compiler blade in a sheet output tray for a printing machine.

In accordance with one aspect of the invention, there is provided a blade for use in an apparatus for urging sheets against registration edges in a sheet compiler. The blade includes a body having a contact surface for contact with the sheets and a locating feature. The locating feature is connected to the body for locating the blade to the apparatus. The locating feature includes a prevention feature for preventing the blade from being inserted into the apparatus in a first orientation and to permit the blade to be inserted into the apparatus in a second orientation, opposed to the first orientation, so that the blade is properly installed into the apparatus.

In accordance with another aspect of the present invention, there is provided an apparatus for urging sheets against registration edges in a sheet compiler. The apparatus includes a holder and a blade secured to the holder. The blade includes a body having a contact surface for contact with the sheets and a locating feature. The locating feature is connected to the body for locating the blade to the apparatus. The locating feature includes a prevention feature for preventing the blade from being inserted into the apparatus in a first orientation and to permit the blade to be inserted into the apparatus in a second orientation, opposed to the first orientation, so that the blade is properly installed into the apparatus.

In accordance with yet another aspect of the present invention, there is provided an apparatus for urging sheets against registration edges in a sheet compiler. The apparatus includes a holder and a blade secured to the holder. The blade includes a body having a contact surface for contact with the sheets and a locating feature. The locating feature is connected to the body for locating the blade to the apparatus. The holder includes a holder location feature. The blade locating feature and the holder locating feature cooperate with each other to secure the blade to the holder. The blade location feature and the holder location feature are selected so as to necessitate the distortion of the resilient blade during assembly of the blade into the holder.

In accordance with yet another aspect of the present invention, there is provided a printing apparatus for attracting charged particles to a substrate. The printing apparatus includes an urging apparatus for urging the substrate against registration edges in a substrate compiler. The urging apparatus includes a holder and a blade secured to the holder. The blade includes a body having a contact surface for contact with the sheets and a locating feature. The locating feature is connected to the body for locating the blade to the apparatus. The locating feature includes a prevention feature for preventing the blade from being inserted into the apparatus in a first orientation and to permit the blade to be inserted into the apparatus in a second orientation, opposed to the first orientation, so that the blade is properly installed into the apparatus.

In accordance with yet another aspect of the present invention, there is provided a printing apparatus for attracting charged particles to a substrate. The printing apparatus includes an urging apparatus for urging the substrate against registration edges in a substrate compiler. The urging apparatus includes a holder and a blade secured to the holder. The blade includes a body having a contact surface for contact with the sheets and a locating feature. The locating feature is connected to the body for locating the blade to the apparatus. The holder includes a holder location feature. The blade locating feature and the holder locating feature cooperate with each other to secure the blade to the holder. The blade location feature and the holder location feature are selected so as to necessitate the distortion of the resilient blade during assembly of the blade into the holder.

For a general understanding of the present invention, as well as other aspects thereof, reference is made to the following description and drawings, in which like reference numerals are used to refer to like elements, and wherein.

It is, therefore, apparent that there has been provided in accordance with the present invention, a quick change swiper blade assembly that fully satisfies the aims and advantages hereinbefore set forth.

While the present invention will be described with a reference to preferred embodiments thereof, it will be understood that the invention is not to be limited to these preferred embodiments. On the contrary, it is intended that the present invention cover all alternatives, modifications, and equivalents as may be included within the spirit and scope of the invention as defined by the appended claims. Other aspects and features of the present invention will become apparent as the description proceeds.

Figure 1:
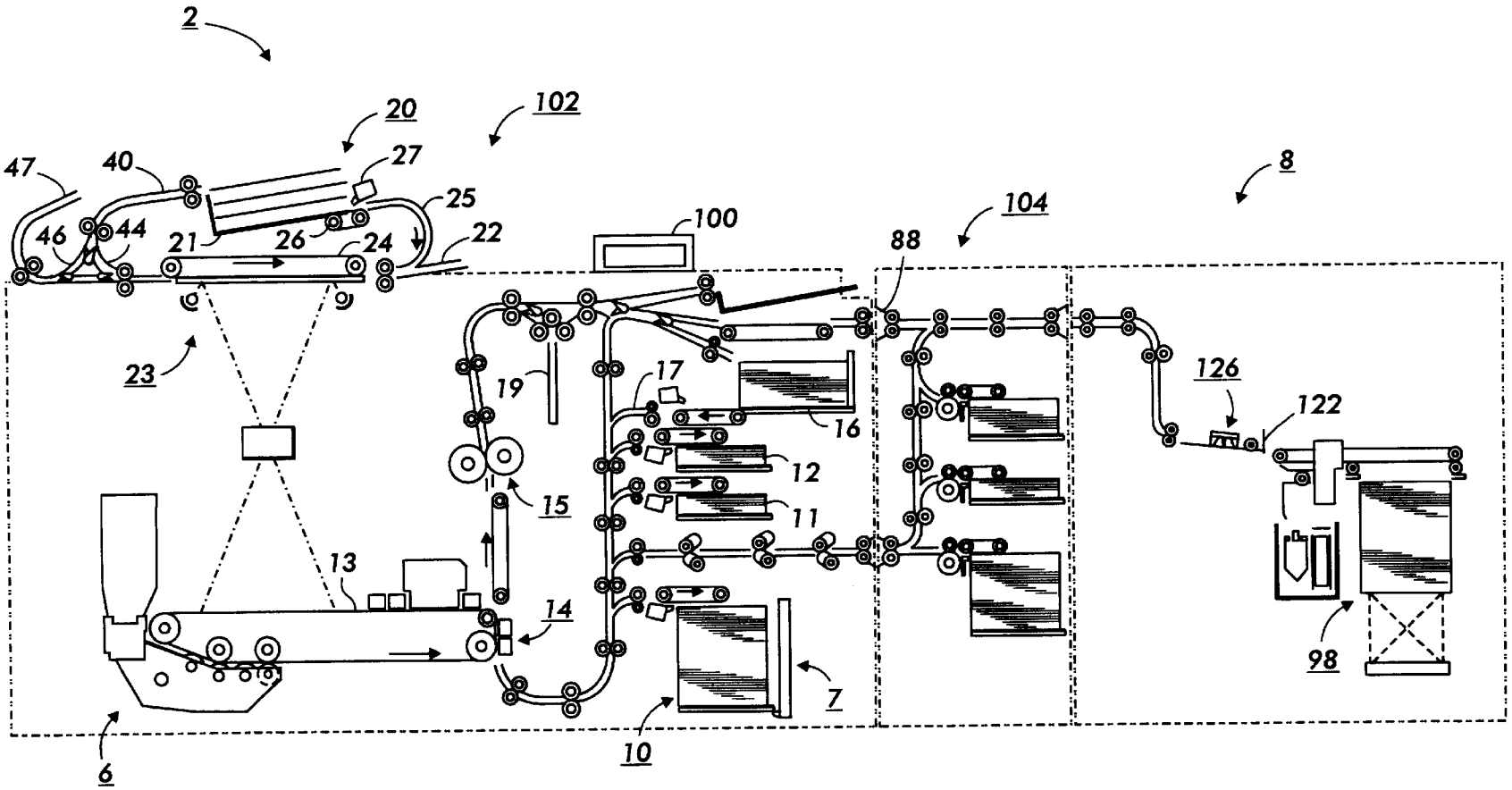
FIG. 1 is a schematic view illustrating the principal mechanical components and paper path of the printing system incorporating the quick change fool proof swiper blade assembly of the present invention.

Inasmuch as the art of electrostatographic processing is well known, the various processing stations employed in a typical electrostatographic copying or printing machine of the present invention will initially be described briefly with reference to FIG. 1. It will become apparent from the following discussion that the paper feeding system of the present invention is equally well suited for use in a wide variety of other electrophotographic or electronic printing systems, as for example, ink jet, ionographic, laser based exposure systems, etc.

In FIG. 1, there is shown, in schematic form, an exemplary electrophotographic copying system 2 for processing, printing and finishing print jobs in accordance with the teachings of the present invention. For purposes of explanation, the copying system 2 is divided into a xerographic processing or printing section 6, a sheet feeding section 7, and a finishing section 8. The exemplary electrophotographic copying system 2 of FIG. 1 incorporates a recirculating document handler (RDH) 20 of a generally known type which may be found, for example, in the well known Xerox Corporation models "1075", "5090" or "5100" duplicators. Such electrostatographic printing systems are illustrated and described in detail in various patents cited above and otherwise, including U.S. Pat. No. 4,961,092, the principal operation of which may also be disclosed in various other xerographic or other printing machines.

A printing system of the type shown herein is preferably adapted to provide, in a known manner, duplex or simplex collated print sets from either duplex or simplex original documents circulated by a document handler. As is conventionally practiced, the entire document handler unit 20 may be pivotally mounted to the copier so as to be liftable by an operator for alternative manual document placement and copying. In this manner, the exemplary printing system or apparatus 2 is designed to receive input documents as manually positioned on an optically transparent platen or automatically positioned thereon via a document handler, such as a recirculating document handler (RDH) 20, via a document handler input tray 21 or a document feeder slot 22.

The RDH 20 operates to automatically transport individual registered and spaced document sheets into an imaging station 23, platen operatively associated with the xerographic processing section 6. A platen transport system 24 is also provided, which may be incrementally driven via a non-slip or vacuum belt system controlled by a system controller 100 for stopping the document at a desired registration (copying) position in a manner taught by various references known in the art.

The RDH 20 has a conventional "racetrack" document loop path configuration, which preferably includes generally known inverting and non-inverting return recirculation paths for transporting original input documents back to the RDH loading and restacking tray 21. An exemplary set of duplex document sheets is shown stacked in this document tray 21. For clarity, the illustrated document and copy sheets are drawn here with exaggerated spacing between the sheets being stacked; in actual operation, these stacked sheets would be directly superposed upon one another. The RDH 20 may be a conventional dual input document handler, having an alternative semiautomatic document handling (SADH) side loading slot 22. Documents may be fed to the same imaging station 23 and transported by the same platen transport belt 24 from either the SADH input slot 22 at one side of the RDH 20, or from the regular RDH input, namely the loading or stacking tray 21, situated on top of the RDH unit. While the side loading slot 22 is referred to herein as the SADH feeding input slot 22, this input feeder is not limited to semi-automatic or "stream feed" document input feeding, but is also known to be usable for special "job interrupt" insert jobs. Normal RDH document feeding input comes from the bottom of the stack in tray 21 through arcuate, inverting RDH input path 25 to the upstream end of the platen transport 24. Input path 25 preferably includes a known "stack bottom" corrugated feederseparator belt 26 and air knife 27 system including, document position sensors (not shown), and a set of turn baffles and feed rollers for inverting the incoming original documents prior to imaging.

Document inverting or non-inverting by the RDH 20 is further described, for example, in U.S. patents U.S. Pat. Nos. 4,794,429 or 4,731,637, among others. Briefly, input documents are typically exposed to a light source on the platen imaging station 23, or fed across the platen without being exposed, after which the documents may be ejected by the platen transport system 24 into downstream or off-platen rollers and further transported past a gate or a series of gates and sensors. Depending on the position of these gates, the documents are either guided directly to a document output path and then to a catch tray, or, more commonly, the documents are deflected past an additional sensor, and into an RDH return path 40. The RDH return path 40 provides a path for leading the documents back to tray 21 so that a document set can be continually recirculated. This RDH return path 40 includes reversible rollers to provide a choice of two different return paths to the RDH tray 21: a simplex return path 44 which provides sheet or document inversion or a reversible duplex return path 46 which provides no inversion, as will be further explained. For the duplex path 46, the reversible rollers are reversed to reverse feed the previous trail edge of the sheet back into the duplex return path 46 from an inverter chute 47. This duplex return path 46 provides for the desired inversion of duplex documents in one circulation as they are returned to the tray 21, for copying opposite sides of these documents in a subsequent circulation or circulations, as described in the above cited art. Typically, the RDH inverter and inversion path 46, 47 are used only for documents loaded in the RDH input tray 21 and for duplex documents. In normal operation, a duplex document has only one inversion per circulation (occurring in the RDH input path 25). By contrast, in the simplex circulation path there are two inversions per circulation, one in each of the paths 24 and 44, whereby two inversions per circulation is equivalent to no inversion such that simplex documents are returned to tray 21 in their original (face up) orientation via the simplex path 44.

The entire stack of originals in the RDH tray 21 can be recirculated and copied to produce a plurality of collated copy sets. In addition, the document set or stack may be recirculated through the RDH any number of times in order to produce any desired number of collated duplex print sets, that is, collated sets of duplex copy sheets, in accordance with various instruction sets known as print jobs which can be programmed into a controller 100, to operator which will be described.

Since the copy or print operation and apparatus of the present invention is well known and taught in numerous patents and other published art, the system will not be described in detail herein. Briefly, blank or preprinted copy sheets are conventionally provided by sheet feeder section 7, whereby sheets are delivered from a high capacity feeder tray 10 or from auxiliary paper trays 11 or 12 for receiving a copier document image from photoreceptor 13 at transfer station 14. In addition, copy sheets can be stored and delivered to the xerographic processing section 6 via auxiliary paper trays 11 or 12 which may be provided in an independent or stand alone device coupled to the electrophotographic printing system 2. After a developed image is transferred to a copy sheet, an output copy sheet is delivered to a fuser 15, and further transported to finishing section 8 (if they are to be simplex copies), or, temporarily delivered to and stacked in a duplex buffer tray 16 if they are to be duplexed, for subsequent return (inverted) via path 17 for receiving a second side developed image in the same manner as the first side. This duplex tray 16 has a finite predetermined sheet capacity, depending on the particular copier design. The completed duplex copy is preferably transported to finishing section 8 via output path 88. An optionally operated copy path sheet inverter 19 is also provided.

All document handler, xerographic imaging sheet feeding and finishing operations are preferably controlled by a generally conventional programmable controller 100. The controller 100 is additionally programmed with certain novel functions and graphic user interface features for the general operation of the electrostatographic printing system 2 and the dual path paper feeder of the present invention. The controller 100 preferably comprises a known programmable microprocessor system, as exemplified by the above cited and other extensive prior art (i.e., U.S. Pat. No. 4,475,156, and its references), for controlling the operation of all of the machine steps and processes described herein, including actuation of the document and copy sheet feeders and inverters, gates, etc. As further taught in the references, the controller 100 also conventionally provides a capability for storage and comparison of the numerical counts of the copy and document sheets, the number of documents fed and recirculated in a document or print set, the desired number of copy sets, and other functions which may be input into the machine by the operator through an input keyboard control or through a variety of customized graphic user interface screens. Control information and sheet path sensors (not shown) are utilized to control and keep track of the positions of the respective document and copy sheets as well as the operative components of the printing apparatus via their connection to the controller. The controller 100 may be conventionally connected to receive and act upon jam, timing, positional and other control signals from various sheet sensors in the document recirculation paths and the copy sheet paths. In addition, the controller 100 can preferably automatically actuate and regulate the positions of sheet path selection gates, including those gates associated with the dual path paper feeder, depending upon the mode of operation selected by the operator and the status of copying in that mode.

It shall be understood from the above description that multiple print jobs, once programmed, are scanned and printed and finished under the overall control of the machine controller 100. The controller 100 controls all the printer steps and functions as described herein, including imaging onto the photoreceptor, paper delivery, xerographic functions associated with developing and transferring the developed image onto the paper, and collation of sets and delivery of collated sets to the binder or stitcher, as well as to the stacking device 98. The printer controller 100 typically operates by initiating a sequencing schedule which is highly efficient in monitoring the status of a series of successive print jobs to be printed and finished in a consecutive fashion. This sequencing schedule may also utilize various algorithms embodied in printer software to introduce delays for optimizing particular operations.

Figure 2:
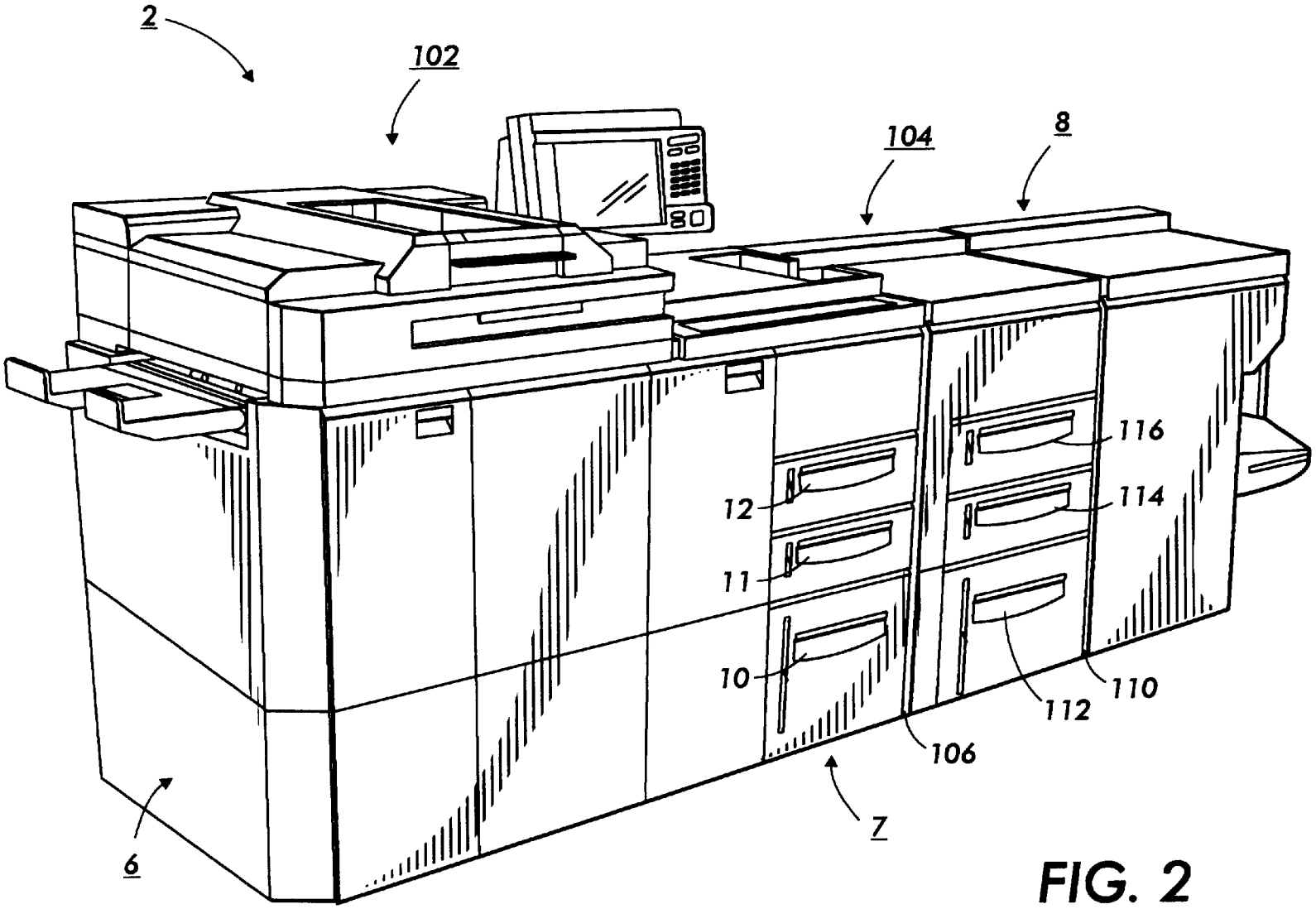
FIG. 2 is a perspective view of the electronic printing system of FIG. 1.

According to the present invention and referring to FIG. 2, a printing system 2 in the form of a copy machine is shown for utilization with a synchronized paper feeding across modular boundaries is shown. The copy machine 2 includes printer module 102 including processing section 6 and sheet feeder section 7.

Adjacent printer module 102 an interposer module 104 may be utilized for storing additional sheets for use in the processing section 6 of the printer module or for inserting preprinted or bland divider sheets into the stream of output from the printer module. A first module boundary 106 separates the printer module 102 from the interposer module 104. Finishing section or module 8 is positioned on the opposed side of the interposer module 104 with a second module boundary being formed between finishing section 8 and interposer module 104.

As previously mentioned, the sheet feeder section 7 includes a high capacity feed tray 12 as well as auxiliary paper trays 10 and 11. Paper within the trays 10–12 must pass through interposer module 104 on their way to the finishing section 8 thereby passing by first module boundary 106 and second module boundary 110.

Similarly, the interposer module 104 includes high capacity interposer feed tray 112, lower auxiliary interposer paper tray 114, and upper auxiliary interposer paper tray 116. The trays 112, 114 and 116 serve as sources for paper to pass either directly to the finishing section 8 or to be fed to the processing section 6 of the printer module 102 and subsequently past to the finishing section 8 through interposer module 104. Paper from the interposer paper trays 112, 114 and 116 may pass by first module boundary 106 as well as second module boundary 110.

According to the present invention and referring again to FIG. 1, a registration apparatus 124 is shown installed in compiler tray 122 within the finishing section 8 of the copy machine 2.

Figure 5:
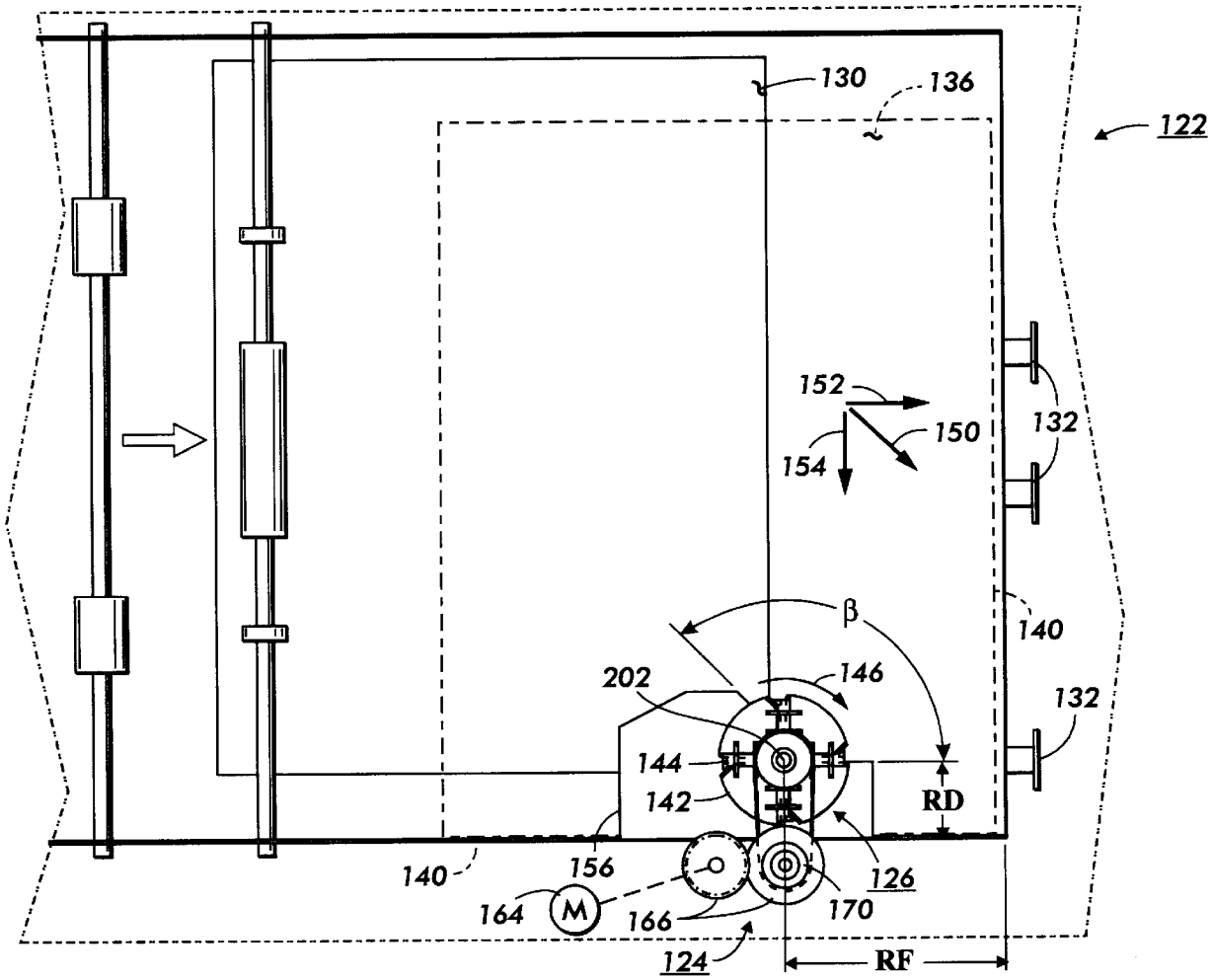
FIG. 5 is a top view of a compiler tray of the printing system of FIG. 1 utilizing the quick change fool proof swiper blade assembly of the present invention.

Referring now to FIG. 5, the registration apparatus 124 within the compiler tray 122 is shown in greater detail. The registration apparatus 124 is associated with the compiler tray 122 and includes an urging device 126 for urging unregistered sheets 130 toward end registration fingers 132 and side registration rail 134. The urging device 126 thus urges unregistered sheet 130 into registered position 136 with edges 140 of the sheet 130 against registration fingers 132 and registration rail 134.

The urging device 126 may have any suitable form but preferably includes a urging tool holder 142 in the form of a blade receptacle. The blade receptacle 142 holds sheet contact tool 144 preferably in the form of a flexible member. The flexible member 142 may be in the form of a blade.

While it should be appreciated that the invention may be practiced with a single blade 144, preferably, a plurality of equally spaced blades 144 are positioned within the blade receptacle 142. For example, as shown in FIG. 5, four equally spaced blades 144 are used.

In order to urge the unregistered sheets 130 into the registered position 136, preferably, the urging device 126 rotates in the direction of arrow 146 causing the unregistered sheet 130 to travel in the direction of arrow 150. It should be appreciated that the motion of the sheet 130 in the direction of arrow 150 includes a first component 152 in the direction of the registration fingers 132 and a second component 154 in direction of rail 134.

To assist in directing the unregistered sheet 130 in the direction of arrow 150, the registration apparatus 124 further includes a guard 156 which is positioned between the sheet 130 and the blades 144 such that only a portion 160 of the motion of the blades 144 is in contact with the sheet 130. The guard 156 thus includes a notch defined by angle β permitting the blades 144 to contact the sheet 130 within the notched area defined by angle β. The angle β preferably extends from the 12 o'clock position in a counterclockwise direction approximately 120 degrees.

The blade receptacle 142 is rotated in the direction of arrow 146 by any suitable means. For example, the blade receptacle 142 may be driven by motor 164 connected to the blade receptacle 142 by a series of gears 166 and pulleys 170.

The blade receptacle 142 rotates in the direction of arrow 146 at a rotational speed Ω sufficient to accelerate the sheet 130 traveling at velocity VS toward the registration fingers 132 and the rail 134. For example, for a printing machine with a capacity of 120 sheets per minute, the blade receptacle 142 may have a revolution of 0 to 800 revolutions per minute with 680 revolutions per minute being preferred.

Figure 3:
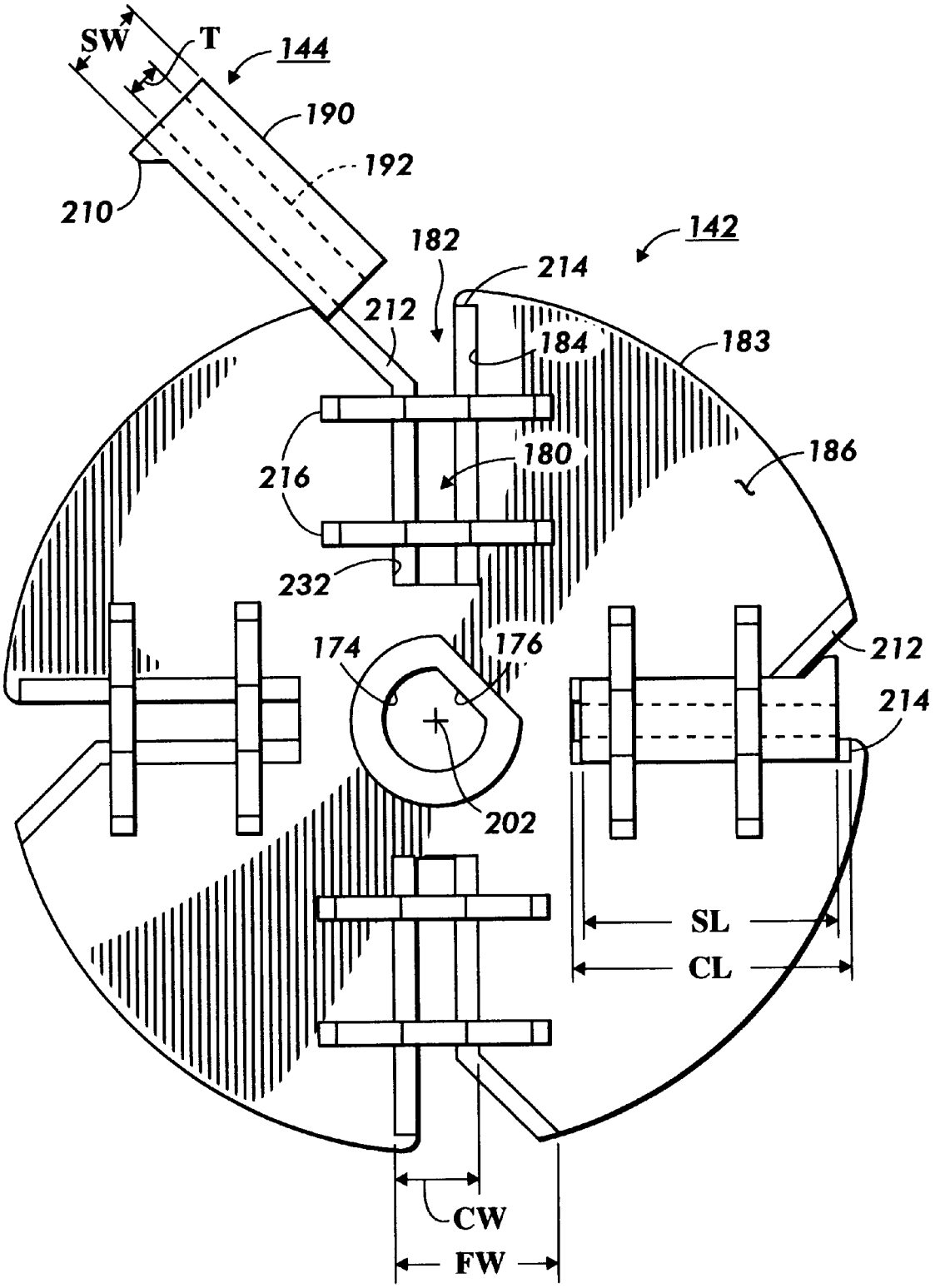
FIG. 3 is a top view of the swiper blade receptacle of the quick change fool proof swiper blade assembly of the present invention showing a swiper blade ready for installation thereunto.

Referring now to FIG. 3, the blade receptacle 142 with the swiper blades 144 assembled thereto is shown in greater detail. The blade receptacle 142 may have any suitable shape and be made of any suitable durable material. For example, the blade receptacle may be made of a metal or a durable plastic. The blade receptacle 142 may be made of glass filled polycarbonate with 10 percent glass filled.

The blade receptacle 142 as shown in FIG. 3 may have a generally disc shaped body. The blade receptacle 142 includes a driver 174 to provide a mechanical link to the motor 164 (see FIG. 5). For example as shown in FIG. 3, the driver 174 is in the form of a cylindrical opening including a D-shaped flat 176. The blade receptacle 142 includes a swiper blade connection in the form of a swiper blade pocket 180. While the blade receptacle 142 may include a solitary pocket 180, preferably, the blade receptacle 142 includes a plurality of equally spaced pockets 180.

As shown in FIG. 3, the blade receptacle 142 includes four equally spaced pockets 180. The pockets 180 may have any suitable shape, but as shown in FIG. 3, include a slot 182 extending inwardly from outer periphery 183 of the receptacle 142. Further, the pockets 180 include a channel 184 adjacent upper face 186 of the receptacle 142.

Again referring to FIG. 3, the swiper blades 144 may have any suitable shape and may be made of any suitable durable material which is flexible to assure contact with the sheets 130 (see FIG. 5). For example, the swiper blades may be made of a soft flexible plastic. The swiper blades 144 may be made of a polyurethane polyester elastomer. The swiper blades 144 have a hardness and are elastic such that they may be bent into contact with the sheets 130. For example, when utilizing a polyurethane polyester elastomer, the swiper blades 144 have a hardness of about 66 durometer. Preferably, the swiper blades 144 are made of a durable, ozone resistant material.

The swiper blades 144 have any shape compatible with the blade receptacle 142. Preferably, the swiper blades 144 include a stop 190 which matingly fits within channel 184 of the blade receptacle 142. The swiper blade further includes a body 192 which has a generally planar shape having a thickness T which is matingly fitted with slot 182 of the blade receptacle 142.

Figure 4:
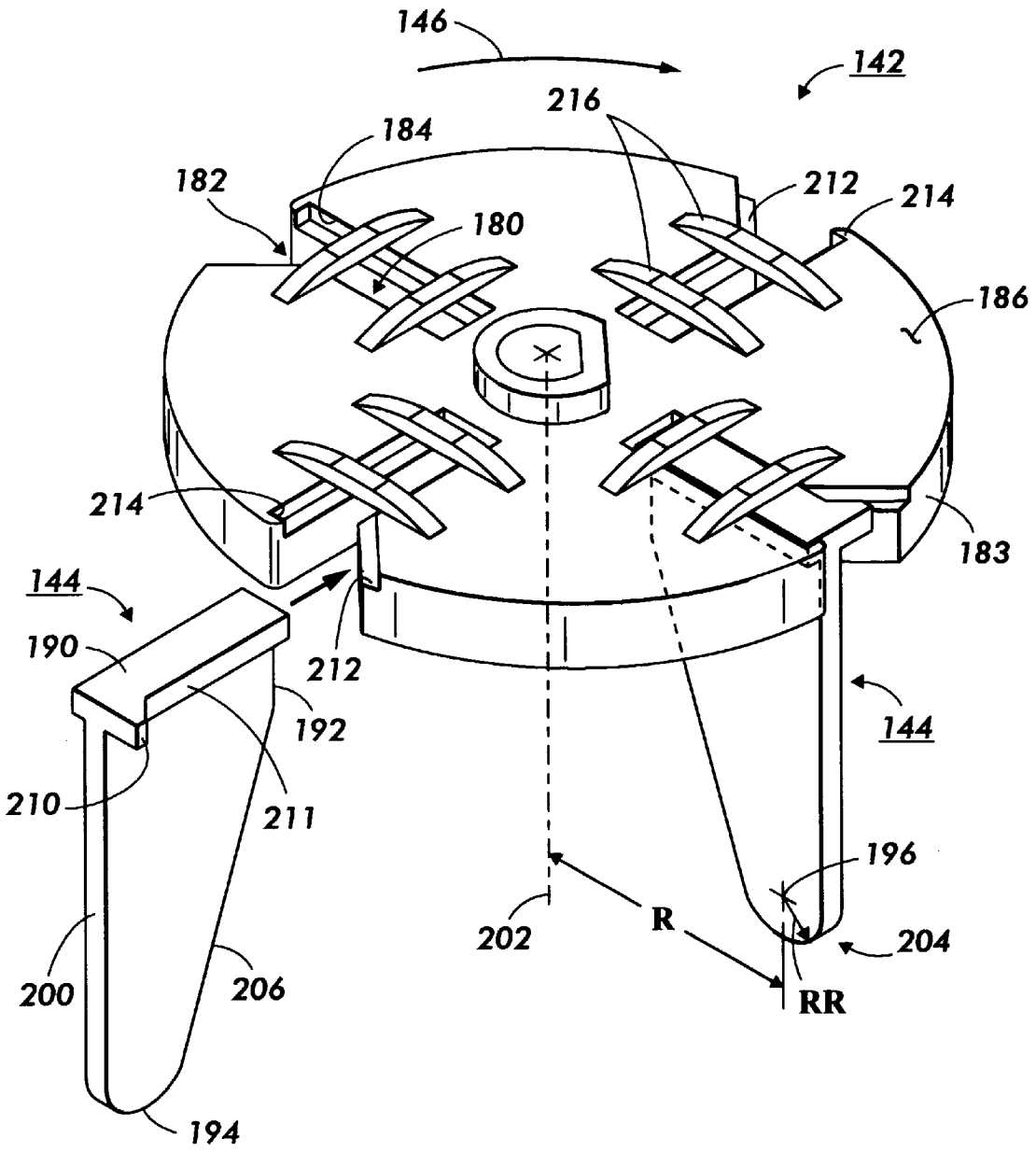
FIG. 4 is a perspective view of the swiper blade receptacle with the swiper blades installed therein for use in the quick change fool proof swiper blade assembly of the present invention.

Referring now to FIG. 4, the body 192 may have any suitable shape but preferably is asymmetrical and includes a swiper blade contact surface 194 which is arcuate. The contact surface 194 preferably is defined by a radius RR having a dimension of 0.05 to 0.50 inches. The radius RR has a centerline 196 which is preferably biased toward outer face 200 of the blade 144. The centerline 196 is biased toward face 200 such that the distance from rotational axis 202 of the blade receptacle 142 to the centerline 196 has a dimension R (se FIG. 3) which is maximized such that the translational speed in the direction of arrow 146 may be maximized for a given size of the blade receptacle 142.

Applicants have found that for a printing machine having a capacity of 120 copies per minute, a blade receptacle 142 with the use of a swiper blade 144 having a contact point 204 on the contact surface 194 at a distance R of approximately 1.28 inches results in a need to rotate the blade receptacle 142 at a rotational speed of approximately 680 rpm to assure the proper registration of sheets 130.

Again referring to FIG. 4, to provide for swiper blades 144 which have contact surface 194 biased toward face 200, the blades 144 have a triangular portion 206 with an included angle α (see FIG. 7) of approximately 20 degrees adjacent the contact surface 194.

Again referring to FIG. 4, the stop 190 may be made of any suitable shape such that it fits within channel 184. Preferably, to assure that the swiper blade 144 is properly assembled into the blade receptacle 142, the swiper blade 144 includes a blade foolproof feature 210 which mates with a receptacle foolproof feature 212 to assure that the blade contact surface 194 is biased toward the outer periphery 183 of the receptacle 142.

While the blade foolproof feature 210 may have any suitable shape, the blade foolproof feature preferably is in the form of a protrusion. The protrusion 210 may have any suitable shape and, as shown in FIG. 3, may have a generally triangular shape. The blade foolproof feature 210 extends beyond face 211 of the stop 190. The stop 190 has a stop width SW approximately equal to channel width CW such that the stop 190 of the swiper blade 144 may slidably be fitted into the channel 184 of the blade receptacle 142. The stop 190, however, at the blade foolproof feature 210 has a width FW greater than width SW at the remaining portion of the stop 190. The width FW is significantly wider than the width CW of the channel 184 such that the face 200 may not be pointing inwardly when assembled into the blade receptacle 142. To permit a complete engagement of the swiper blade 144 into the blade receptacle 142, preferably, the receptacle foolproof feature 212 provides clearance for the blade foolproof feature 210 when the swiper blade 144 is properly assembled.

Preferably, to prevent the swiper blade 144 from escaping tangentially from the blade receptacle 144, the blade receptacle 142 includes an outer lip 214 which extends inwardly from channel 184 adjacent the outer periphery 183 of the blade receptacle 142. The outer lip 214 serves to secure the swiper blade 144 within the channel 184. To secure the swiper blade 144 within the direction of axis 202, the blade receptacle 142 further includes a strap 216 secured to upper face 186 of the blade receptacle 142. The straps 216 prevent the upward movement of the swiper blades 144 when installed within the blade receptacle 142. While a single strap may be sufficient for each channel 184, preferably two straps 216 are located at each channel 184.

Figure 7:
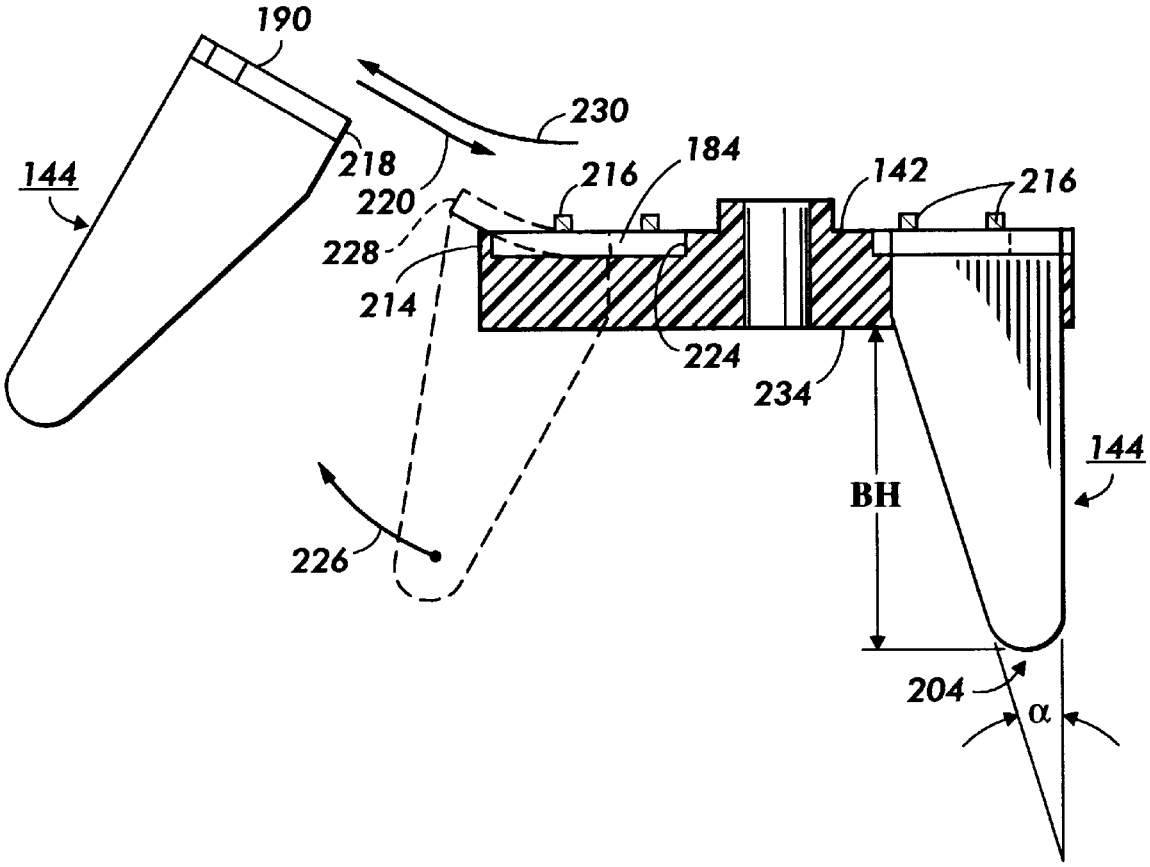
FIG. 7 is a plan view of a swiper blade being flexed to permit its removal from a pocket of the swiper blade receptacle of the quick change fool proof swiper blade assembly of the present invention.

Referring now to FIG. 7, the installation of the swiper blade 144 into the channel 184 of the blade receptacle 142 is shown in greater detail.

When installing a swiper blade 144 into the blade receptacle 142, lead edge 218 of the stop 190 is urged into the channel 184 of the blade receptacle 142 by positioning the lead edge 218 between lip 214 and strap 216. The stop 190 of the blade 144 is fed in the direction of arrow 220 until lead edge 218 contacts inner surface 224 of the channel 184.

When removing a blade 144 from the blade receptacle 142, the blade 144 is pivoted in the direction of arrow 226 such that the outer edge 228 of the stop 190 is positioned between the lip 214 and the strap 216 and continually pulled in the direction of arrow 230 until the blade 144 is removed from the blade receptacle 142.

Referring now to FIG. 4, the blades 144 are shown removed, as well as, installed into the blade receptacle 142.

The stop 190 of the blades 144 has a length SL which is slightly smaller than length CL of the channel 184.

It should be appreciated that the receptacle foolproof feature 212 in the form of the relief in the channel 184 near the periphery 183 of the receptacle 142 permits the blades 144 to be positioned with the protrusion 210 being adjacent the outer periphery 183 while prohibiting the protrusion 210 from being located within narrow, inner portion 232 of the channel 184.

Figure 6:
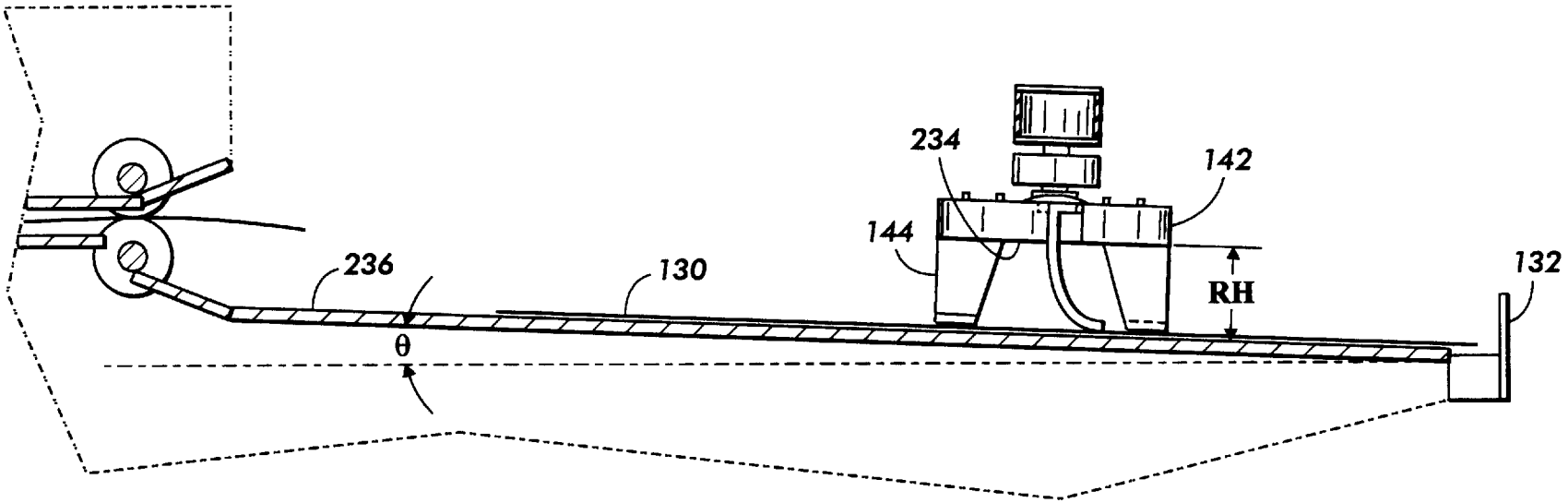
FIG. 6 is a plan view of the compiler tray of the printing system of FIG. 1 showing the quick change fool proof swiper blade assembly of the present invention in contact with a sheet.

Referring now to FIG. 6, the blades 144 are preferably collapsed to permit contact with the sheet 130. Lower surface 234 of the blade receptacle 142 is positioned from the sheet 130 a distance RH of approximately 90 to 40 percent of the blade height from the lower surface 234 to the contact point 204 of the blade 144 having a dimension BH (see FIG. 7). To assure that the sheet 130 is seated properly against registration fingers 132, preferably, the compiler tray 122 includes a compiler tray support surface 236 which has an angle Φ of approximately 2 degrees pointing downward toward the registration fingers 132.

Referring now to FIG. 5, the registration apparatus 124 is positioned such that centerline axis 202 of the blade receptacle 142 permits the blades 144 to urge the sheet 130 toward registration fingers 132 and rail 134. For example, as shown in FIG. 5, the blade receptacles centerline 202 is positioned a distance RD from the rail 134 of approximately 2 inches and a distance RF from the registration fingers 132 of approximately 5 inches.

By providing a swiper blade including a blade foolproof feature, the blade may be only inserted into the blade receptacle in the proper direction.

By providing a swiper blade with a contact surface adjacent the outer periphery of the blade receptacle, the contact point of the blade may be optimized near the outer periphery of the blade receptacle.

By providing a blade receptacle including a channel which mates with a stop on a blade the blade may be slidably fitted within the blade receptacle.

By providing blade receptacle including a passage between a channel and a lip, requiring the distortion of the blade during installation and removal, a blade may be provided which may be installed and removed without any operator tools, yet be safely secured during operation.

By providing a blade and a blade receptacle in which the blade is installed by passing the blade within a passage between a channel and a lip of a blade receptacle, requiring the distortion of the blade during installation and removal, a blade and a blade receptacle may be provided which permits the blade to be installed and removed without any tools, no fastening devices and minimal instruction. The blades utilized in this blade and blade receptacle system may easily performed by a copy or printing machine operator. Service costs and down time associated with changing blades can thus be drastically reduced by utilizing in this blade and blade receptacle system It is, therefore, evident that there has been provided, in accordance with the present invention, an electrostatographic copying apparatus that fully satisfies the aims and advantages of the invention as hereinabove set forth. While the invention has been described in conjunction with a preferred embodiment thereof, it is evident that many alternatives, modifications, and variations will be apparent to those skilled in the art. Accordingly, it is intended to embrace all such alternatives, modifications and variations as fall within the spirit and broad scope of the appended claims.

We claim:

1. A blade for use in an apparatus for urging sheets against registration edges in a sheet compiler, comprising:

a body, said body including a contact surface for contact with the sheets; and a locating feature connected to said body for locating said blade to the apparatus, the locating feature including a prevention feature for preventing the blade from being inserted into the apparatus in a first orientation and to permit the blade to be inserted into the apparatus in a second orientation, opposed to the first orientation, so that the blade is properly installed into the apparatus.

2. The blade as claimed in claim 1, wherein said body and said locating feature have a one-piece construction.

3. The blade as claimed in claim 1, wherein the prevention feature comprises a protrusion.

4. The blade as claimed in claim 3, wherein the protrusion is triangular.

5. The blade as claimed in claim 1, wherein:

said body is substantially planar; and said locating feature stop is substantially planar and perpendicular to said body.

6. The blade as claimed in claim 1, wherein said body comprises a resilient material.

7. An apparatus for urging sheets against registration edges in a sheet compiler, comprising:

a holder; and a blade secured to the holder, said blade including a body, said body including a contact surface for contact with the sheets and a locating feature connected to said body for locating said blade to the apparatus, the locating feature including a prevention feature for preventing the blade from being inserted into the apparatus in a first orientation and to permit the blade to be inserted into the apparatus in a second orientation, opposed to the first orientation, so that the blade is properly installed into the apparatus.

8. The apparatus as claimed in claim 7, wherein said body and said locating feature have a one-piece construction.

9. The apparatus as claimed in claim 7, wherein the prevention feature comprises a protrusion.

10. The apparatus as claimed in claim 9, wherein the protrusion is triangular.

11. The apparatus as claimed in claim 7, wherein:

said body is substantially planar; and said locating feature is substantially planar and perpendicular to said body.

12. The apparatus as claimed in claim 7, wherein said body comprises a resilient material.

13. An apparatus for urging sheets against registration edges in a sheet compiler, comprising:

a holder; and a resilient blade secured to the holder, said blade including a body, said body including a contact surface for contact with the sheets and a blade locating feature connected to said body for locating said blade to the apparatus, said holder including a holder locating feature, said blade locating feature and said holder locating feature cooperating with each other to secure said blade to said holder, said blade locating feature and said holder locating feature being selected so as to necessitate the distortion of said resilient blade during assembly of said blade into said holder.

14. The apparatus as claimed in claim 13, wherein said blade locating feature further comprises a prevention feature for preventing the blade from being inserted into the apparatus in a first orientation and to permit the blade to be inserted into the apparatus in a second orientation, opposed to the first orientation, so that the blade is properly installed into the apparatus.

15. The apparatus as claimed in claim 14, wherein the prevention feature comprises a protrusion.

16. The apparatus as claimed in claim 14, wherein:

said blade locating feature comprises a bar; and said holder defines a slot therein, the holder locating feature being defined by the slot.

17. The apparatus as claimed in claim 16, wherein:

said holder defines a slot longitudinal axis;

said holder defines a blade passageway, said blade passageway having a longitudinal axis thereof, said blade passageway providing entry of said blade into the slot, the longitudinal axis of the slot and the longitudinal axis of the passageway being skewed with respect to each other such that said resilient blade must be distorted during assembly of said blade into said holder.

18. A printing apparatus for attracting charged particles to a substrate, said printing apparatus including an urging apparatus for urging the substrate against registration edges in a substrate compiler, said urging apparatus including:

a holder; and a blade secured to the holder, said blade including a body, said body including a contact surface for contact with the sheets and a locating feature connected to said body for locating said blade to the apparatus, the locating feature including a prevention feature for preventing the blade from being inserted into the urging apparatus in a first orientation and to permit the blade to be inserted into the urging apparatus in a second orientation, opposed to the first orientation, so that the blade is properly installed into the urging apparatus.

19. The printing apparatus as claimed in claim 18, wherein said body and said locating feature have a one-piece construction.

20. The printing apparatus as claimed in claim 18, wherein the prevention feature comprises a protrusion.

21. The printing apparatus as claimed in claim 20, wherein the protrusion is triangular.

22. The printing apparatus as claimed in claim 18, wherein:

said body is substantially planar; and said locating feature is substantially planar and perpendicular to said body.

23. The printing apparatus as claimed in claim 18, wherein said body comprises a resilient material.

24. A printing apparatus for attracting charged particles to a substrate, said printing apparatus including an urging apparatus for urging the substrate against registration edges in a substrate compiler, said urging apparatus including:

a holder; and a resilient blade secured to the holder, said blade including a body, said body including a contact surface for contact with the sheets and a blade locating feature connected to said body for locating said blade to the apparatus, said holder including a holder locating feature, said blade locating feature and said holder locating feature cooperating with each other to secure said blade to said holder, said blade locating feature and said holder locating feature being selected so as to necessitate the distortion of said resilient blade during assembly of said blade into said holder.

25. The apparatus as claimed in claim 24, wherein said blade locating feature further comprises a prevention feature for preventing the blade from being inserted into the apparatus in a first orientation and to permit the blade to be inserted into the apparatus in a second orientation, opposed to the first orientation, so that the blade is properly installed into the apparatus.

26. The apparatus as claimed in claim 25, wherein the prevention feature comprises a protrusion.

27. The apparatus as claimed in claim 24, wherein:

said blade locating feature comprises a bar; and said holder defines a slot therein, the holder locating feature being defined by the slot.

28. The apparatus as claimed in claim 27, wherein:

said holder defines a slot longitudinal axis;

said holder defines a blade passageway, said blade passageway having a longitudinal axis thereof, said blade passageway providing entry of said blade into the slot, the longitudinal axis of the slot and the longitudinal axis of the passageway being skewed with respect to each other such that said resilient blade must be distorted during assembly of said blade into said holder.

* * * * *